US007108047B2

(12) United States Patent
Marti et al.

(10) Patent No.: US 7,108,047 B2
(45) Date of Patent: Sep. 19, 2006

(54) METHOD FOR OPERATING A STRIP CASTING MACHINE AND JACKET RING FOR A CASTING ROLL USED TO CARRY OUT SAID METHOD

(75) Inventors: Heinrich Marti, Forch (CH); Jacques Barbé, Tarantaise (FR)

(73) Assignees: SMS Demag AG, Düsseldorf (DE); Main Management Inspiration AG, Hergiswil (CH)

( * ) Notice: Subject to any disclaimer, the term of this patent is extended or adjusted under 35 U.S.C. 154(b) by 0 days.

(21) Appl. No.: 10/451,964

(22) PCT Filed: Dec. 21, 2001

(86) PCT No.: PCT/EP01/15277

§ 371 (c)(1),
(2), (4) Date: Oct. 20, 2003

(87) PCT Pub. No.: WO02/053312

PCT Pub. Date: Jul. 11, 2002

(65) Prior Publication Data

US 2004/0045696 A1 Mar. 11, 2004

(30) Foreign Application Priority Data

Dec. 30, 2000 (CH) ..... 2541/00

(51) Int. Cl.
*B22D 11/06* (2006.01)

(52) U.S. Cl. ..... 164/480; 164/428

(58) Field of Classification Search ..... 164/428, 164/480

See application file for complete search history.

(56) References Cited

U.S. PATENT DOCUMENTS

| | | | | |
|---|---|---|---|---|
| 5,103,895 | A * | 4/1992 | Furuya et al. | 164/475 |
| 5,584,338 | A * | 12/1996 | Freeman et al. | 164/478 |
| 5,660,224 | A * | 8/1997 | Barbe et al. | 164/415 |
| 5,720,336 | A * | 2/1998 | Strezov | 164/480 |
| 5,787,967 | A * | 8/1998 | Vendeville et al. | 164/452 |
| 6,470,550 | B1 * | 10/2002 | Kowalczyk et al. | 29/402.18 |
| 6,491,089 | B1 * | 12/2002 | Poirier et al. | 164/480 |
| 6,575,225 | B1 * | 6/2003 | Hohenbichler et al. | 164/480 |

FOREIGN PATENT DOCUMENTS

| | | | |
|---|---|---|---|
| EP | 0409645 | | 1/1991 |
| EP | 0477121 | | 3/1992 |
| EP | 1038612 | | 9/2000 |
| JP | 59-21416 | * | 2/1984 |
| WO | 9602340 | | 2/1996 |
| WO | 9852706 | | 11/1998 |

* cited by examiner

*Primary Examiner*—Kuang Y. Lin
(74) *Attorney, Agent, or Firm*—Friedrich Kueffner

(57) ABSTRACT

The invention relates to a method for operating a strip casting machine (10), whereby molten metal (18) is poured between two rotatable casting rolls (11, 12). A gaseous film (G) is formed between the respective surfaces (11', 12') of the casting rolls and the strip skin (D1, D2, D3) forming on the molten metal, the gas being introduced essentially into the inerting chamber (24 ) above the metal bath. During the casting, a controlled quantity of a gas consisting of argon, nitrogen and/or another gas is introduced into the inerting chamber (24) in such a way that the heat transfer from the strip skin to the casting rolls (11, 12) can be influenced by the thickness of the gaseous film (G) in such a way that the surfaces (11, 12') of the casting rolls can be provided with or without cavities (51). A smooth surface can thus also be obtained on the strip cast.

6 Claims, 2 Drawing Sheets

METHOD FOR OPERATING A STRIP CASTING MACHINE AND JACKET RING FOR A CASTING ROLL USED TO CARRY OUT SAID METHOD

BACKGROUND OF THE INVENTION

The invention concerns a process for operating a strip-casting machine, in which molten metal is poured between two rotating casting rolls, and a gaseous film is formed between the surface of each casting roll and the strip skin forming on the molten metal at the surface of the casting roll, with the gas being introduced into the inerting chamber located above the metal bath. The invention also concerns a jacket ring for the casting roll of the strip-casting machine.

In a casting roll of the type described in document EP-A-0 309 247, uniformly distributed depressions are incorporated in the surface of the roll and are spaced some distance apart. These depressions result in the formation of gas bubbles during casting and thus prevent primary cracks in the strip skin of the solidified molten metal and, in addition, are intended to provide sufficient thermal conductivity. However, these depressions also lead to a corresponding roughness of the surface of the cast metal strip. Furthermore, these casting rolls must be refinished after relatively short times, since the depressions, which can measure up to 100 micrometers, decrease in size as the surface of the roll wears. In addition, these depressions or textures, in which dirt accumulates relatively fast, must be frequently cleaned.

SUMMARY OF THE INVENTION

Therefore, the object of the present invention is to develop a process of the type mentioned above, by which the surface roughness of the metal strip to be cast can be determined, even with the use of casting rolls with depressions distributed over their surface.

In accordance with the invention, this object is achieved by feeding a controlled amount of a gas consisting of argon, nitrogen, and/or another gas into the inerting chamber during casting, so that the heat transfer from the strip skin to the casting roll can be influenced in a way by the thickness of the gaseous film which forms, such that the surface of the casting roll may or may not be provided with depressions, and a smooth surface of the strip to be cast can be produced.

In a very advantageous embodiment, a well-defined mixture of argon and nitrogen is used as the gas, by which the roughness of the surface of the strip to be cast can be adjusted as desired.

In the vicinity of the depressions, the larger gas cushions partially cause less heat to be eliminated, which leads to a pitted structure of the resulting strip and thus greater expansion in the depressed region of the surface of the rolls, so that potential shrinkage cracks can be avoided.

This process in accordance with the invention makes it possible to minimize the surface roughness of the metal strip to be cast by the use of a well-defined gas mixture.

Specific embodiments and further advantages of the invention are explained in greater detail below with reference to the drawings.

DETAILED DESCRIPTION OF THE INVENTION

Figure 1:
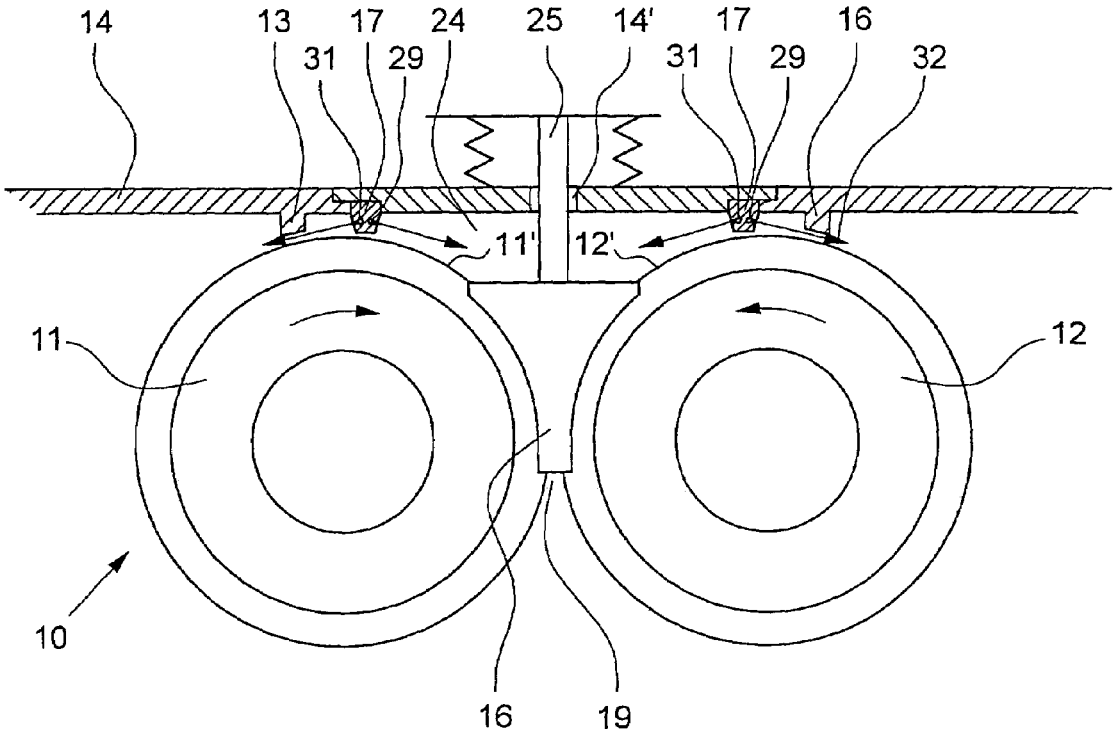
FIG. 1 shows a partial cross section of a strip-casting machine near the casting rolls.

FIG. 1 shows part of a strip-casting machine 10, which is used especially for producing steel strips, with two casting rolls 11, 12, a lateral seal 16, and an upper sealing element 14 with sealing strips 13, 17. Two casting rolls 11, 12 with horizontal axes of rotation are spaced a certain distance apart, and the metal strip being produced passes through the resulting gap 19 between the casting rolls 11, 12. A casting pipe 25 extends through a sealed hole 14' in the upper sealing element 14 from the drain of a tank, which is not shown in detail. Above the metal bath formed between the rolls 11, 12, a closed inerting chamber 24 is formed, which can be filled with an inerting gas through a connecting line 29 on either side. Advantageously, an additional protective gas 32 is blown away from the chamber 24 towards each of the roll surfaces 11', 12' through another connecting line 31 to keep the roll surfaces free of any oxygen accumulation.

Figure 2:
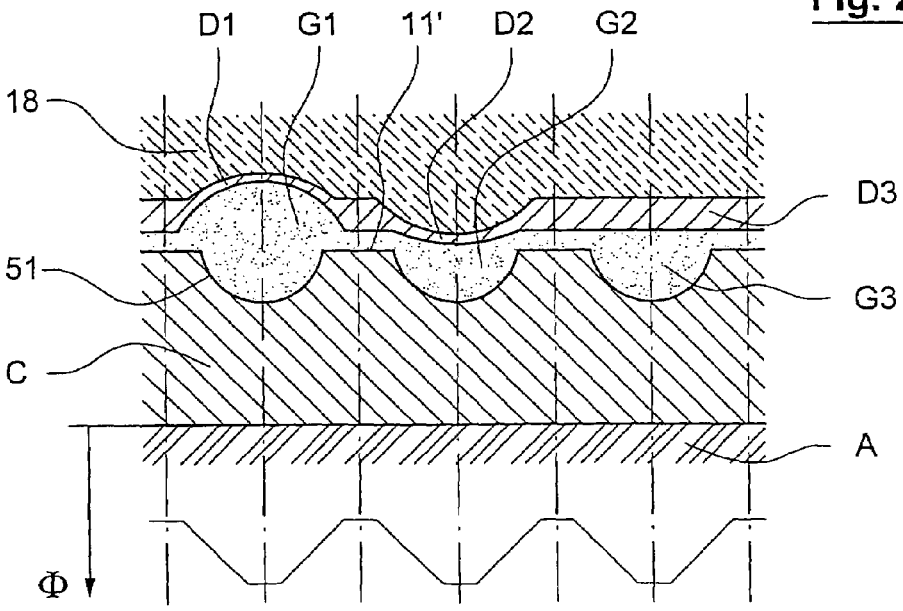
FIG. 2 shows a schematic section of an enlarged part of a jacket ring and a gaseous film and strip skin of the metal being cast.

In accordance with FIG. 2, a gaseous film is formed between the given casting roll surface 11' and the strip skin D of the molten metal 18 that forms at the surface of the roll, where the gas is introduced essentially into the inerting chamber 24 located above the metal bath.

In the process of the invention, a controlled amount of a gas G3, which consists of argon, nitrogen, and/or a third gas, is fed into the inerting chamber 24 through the connecting line 29 during casting, so that the heat transfer from the strip skin D3 to the casting roll 11, 12 can be influenced in such a way by the resulting film thickness of the gaseous film G3 that the surface 11', 12' of the casting rolls may (or may not) be provided with depressions, and a smooth surface of the strip to be cast can be produced.

In regard to the jacket ring for each casting roll 11, 12, the base material A is provided with a coating of an additional layer of material C, which contains particles of ceramic or cement. This ceramic layer C applied to the base material A has depressions 51 in the micrometer range distributed over its entire surface, which can be produced, for example, by grit blasting or laser roughening. These depressions result in an indicated heat transfer $\phi$, which manifests itself in a sawtooth-shaped curve.

FIG. 2 illustrates three variants involving the use of different gases G1, G2, G3 to show the basic behavior of the different gases.

Gas G1 consists mostly of argon, which does not diffuse into the metal being cast and thus experiences expansion in the depression due to heating, so that a depression in the micrometer range forms in the strip skin D1, and the skin is thinner here than in the region adjacent to the depression.

Gas G2 consists mostly of nitrogen, which partially diffuses into the metal 18 being cast. Accordingly, the strip skin D2 shows a tendency to bulge out in this case.

Gas G3 consists of a mixture of argon and nitrogen. When this mixture is used, the ideal state is achieved in accordance with the invention, i.e., the strip skin D3 neither bulges nor is depressed, so that a smooth surface is formed on the strip being produced. This smooth surface can be produced in the metal strip without much expense by the controlled amount of the well-defined mixture or argon and nitrogen.

The base metal A is produced from pure copper, a copper alloy with the principal alloying elements Cu and Ag, or Cu, Cr, and Zr, or Cu, Ni, and Be (beryllium), or steel, especially an alloy steel. It is characterized by good thermal conductivity, which ensures that the water flowing through a cooling channel in the jacket ring of the casting roll eliminates as much thermal energy as possible.

Figure 3:
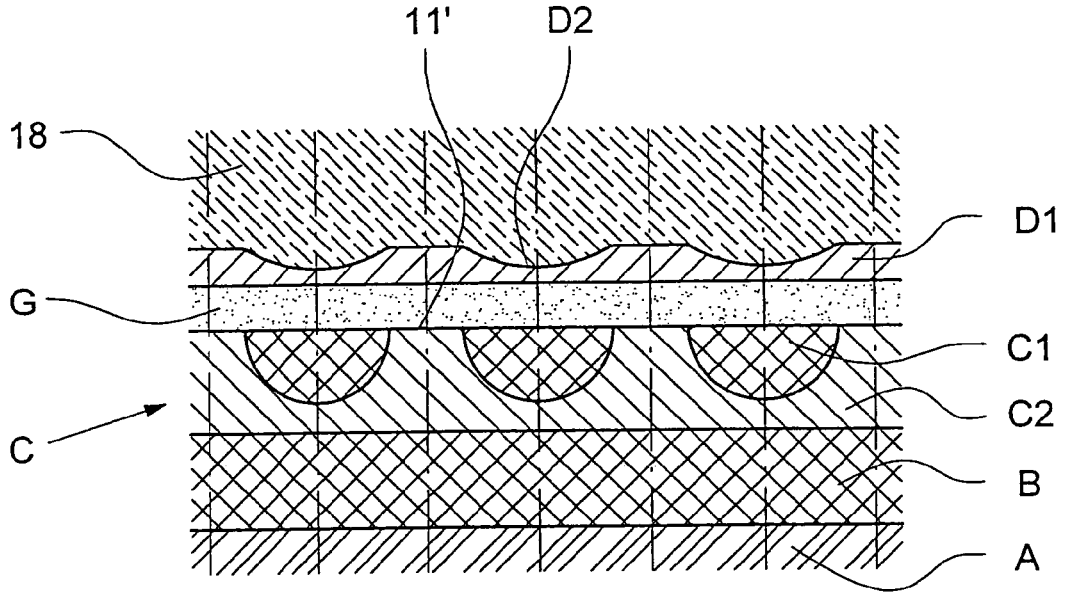
FIG. 3 shows a schematic section of an enlarged part of the jacket ring and a gaseous film and strip skin.

FIG. 3 shows an enlarged section of a cylindrical surface, which is smoothly formed, preferably with a surface roughness of less than 6 micrometers, and especially less than 1 micrometer, and therefore has been fine machined by grinding or turning. In addition, the base material A is provided with a layer of material B, which preferably consists of nickel, steel, and/or chromium. The layer of material B and the layer of material C are applied by a thermal spraying process, for example, plasma spraying or flame spraying, by HIP cladding, or by another coating method, for example, electrolysis.

For example, the base material A may consist of steel or a steel alloy, while the layer of material B consists of alloy steel and is produced by welding application, and the layer of material C consists of a thin coating of ceramic about 0.2 to 0.4 millimeters thick.

The layer of material C, which consists of two different ceramic materials C1, C2, is applied to the layer of material B in such a way that the ceramic material C2 extends over the entire cylindrical surface, and the other ceramic material C1 is embedded in the first material C2 in the form of particles that are spaced a more or less uniform distance apart. This ensures adequate protection of the layer of material B and the base material A and at the same time produces sufficient thermal conductivity. The wear of the material layer C is very low due to the selection of the materials C1 and C2. Especially $Al_2O_3$, $SiAl_2O_2$, $PSZrO_2$, $Si_3N_4$, SiAlON, SiAlYON, and/or SiC may be used for the ceramic or cement coatings C1, C2.

Again, in accordance with the invention, a controlled amount of a gas, which consists of argon, nitrogen, and/or a third gas, is fed into the inerting chamber during casting, so that the heat transfer from the strip skin to the casting roll can be influenced in such a way by the resulting film thickness of the gaseous film G that the strip skin D1 forms a smooth surface. The ceramic material C1, which is embedded in the first material in the form of particles that are spaced a more or less uniform distance apart, produces a different heat transfer, which is smaller in the vicinity of the particles C1 than at C2, with the result that the strip skin D2 is reduced at C1. An equalizing effect is achieved with the gaseous film G, which is composed of a well-defined mixture of gases, so that it is possible to produce the desired smooth surface of the strip.

The surfaces 11', 12' of the casting rolls may also have a surface roughness of 6–10 micrometers and be provided only with the applied layer of material C without finishing.

After being used, when its surface coating has been worn by at least 0.1 to 0.4 millimeters, the jacket ring of the casting roll 11, 12 is advantageously recoated to the original diameter for further use. After sufficient wear has occurred, this is done by applying a layer of material C that consists of ceramic particles or a cement coating.

The invention is sufficiently demonstrated by the embodiments explained above. However, it could also be presented in other variants. For example, the layer of material B and the layer of material C, which consists of the ceramic particles, could be applied to the base material at the same time.

The invention claim is:

1. Process for producing a metal strip with a strip-casting machine, comprising the steps of pouring molten metal (18) between two rotating casting rolls (11, 12) each having a jacket ring, forming a gaseous film (G) between the surface (11', 12') of each casting roll and the strip skin (D1, D2, D3) forming on the molten metal at the surface of the casting roll by introducing the gas into the inerting chamber (24) located above the metal bath, wherein each jacket ring has a base layer material (A), a material layer (B) applied on the base material layer (A), and an additional layer of material (C) applied on the layer (B) that contains at least two different ceramic materials (C1, C2), oxide and/or nonoxide ceramics and/or cement, whereby one of the ceramic materials (C1) extends over the entire jacket surface of the jacket ring and the other ceramic material (C2) being embedded in the ceramic material (C1) as particles that are spaced a substantially uniform distance apart, the two different ceramic materials (C1, C2) of the material layer (C) having different thermal conductivities, and feeding a defined mixture of argon and nitrogen into the inerting chamber (24) during casting, so that the heat transfer from the strip skin to the casting roll (11, 12) is influenced by the thickness of the gaseous film (G) which forms so that the surface (11', 12') of the casting roll is not provided with depressions (51), and a smooth surface of the strip to be cast is produced.

2. Process in accordance with claim 1, wherein the gas consists mostly of argon, which does not diffuse into the metal (18) being cast.

3. Process in accordance with claim 1, wherein the gas consists mostly of nitrogen.

4. Process in accordance with claim 1, wherein the surface (11', 12') of the casting rolls has a surface roughness of 6–10 micrometers and is provided only with the applied layer of material (C).

5. Process in accordance with claim 1, wherein the cylindrical surface (11', 12') of the casting rolls is smoothly formed and has a surface roughness of less than 6 micrometers, and to this end is ground and/or polished.

6. Process in accordance with claim 1, wherein the cylindrical surface (11', 12') of the casting rolls has a surface roughness of less than 1 micrometer.

* * * * *